US010794395B2

(12) United States Patent
Tamada

(10) Patent No.: US 10,794,395 B2
(45) Date of Patent: Oct. 6, 2020

(54) PIPE DIFFUSER OF CENTRIFUGAL COMPRESSOR

(71) Applicant: HONDA MOTOR CO., LTD., Tokyo (JP)

(72) Inventor: Shunichiro Tamada, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 70 days.

(21) Appl. No.: 16/355,983

(22) Filed: Mar. 18, 2019

(65) Prior Publication Data

US 2019/0293087 A1 Sep. 26, 2019

(30) Foreign Application Priority Data

Mar. 20, 2018 (JP) ..... 2018-052428

(51) Int. Cl.
*F04D 29/44* (2006.01)

(52) U.S. Cl.
CPC ..... *F04D 29/441* (2013.01)

(58) Field of Classification Search
CPC ..... F04D 29/441; F01D 9/02
See application file for complete search history.

(56) References Cited

U.S. PATENT DOCUMENTS 6,123,506 A * 9/2000 Brand ..... F04D 29/441 415/208.3
6,280,139 B1 * 8/2001 Romani ..... F04D 29/441 415/207
8,038,392 B2 * 10/2011 Honda ..... F04D 29/441 415/208.3
9,874,223 B2 * 1/2018 Theratil ..... F04D 29/441

FOREIGN PATENT DOCUMENTS

JP 2003-512569 4/2003
JP 2009-041561 2/2009
JP 2010-007676 1/2010

* cited by examiner

*Primary Examiner* — Ninh H. Nguyen
(74) *Attorney, Agent, or Firm* — Rankin, Hill & Clark LLP

(57) ABSTRACT

In a pipe diffuser (50) of a centrifugal compressor including a plurality of diffuser pipes (51), each diffuser pipe internally defines a diffuser passage including an inlet passage portion (74) having a diffuser inlet opposing an outer periphery of the impeller, an outlet passage portion (78) having a diffuser outlet (76) opening in an axial direction of the impeller, the outlet passage portion having an oval cross section elongated in a circumferential direction of the impeller, and a curved passage portion (80) connecting the inlet passage portion and the outlet passage portion to each other, wherein a part of each diffuser pipe defining the outlet passage portion is provided with a bulging part (82) that bulges into the diffuser passage from a radially inner side thereof with respect to the impeller.

5 Claims, 6 Drawing Sheets

PIPE DIFFUSER OF CENTRIFUGAL COMPRESSOR

TECHNICAL FIELD

The present invention relates to a pipe diffuser of a centrifugal compressor, and in particular to a pipe diffuser used in a centrifugal compressor for a gas turbine engine or the like.

BACKGROUND ART

A previously know diffuser of a centrifugal compressor for a gas turbine engine or the like, known as pipe diffuser, includes a plurality of diffuser pipes arranged circumferentially around the impeller of the centrifugal compressor at a prescribed interval. See JP2003-512569A, JP2009-41561A and JP2010-7676A, for instance.

Each diffuser pipe is provided with an inlet portion opposing the outer periphery of the impeller, an outlet portion opening in the axial direction of the impeller, and a diffuser passage which is curved as it extends from the inlet portion to the outlet portion so as to convert a radial air flow received from the impeller into an axial flow directed substantially in parallel with the axial line of the impeller. The diffuser passage has a cross sectional area that progressively increases from the inlet portion to the outlet portion so as to convert the kinetic energy of the working fluid received from the impeller to pressure energy, and the cross section of the diffuser passage is provided with a simple oval or track-shape which is elongated in the circumferential direction.

In order to ensure the performance of the diffuser pipe, it is necessary to increase the opening area ratio between the inlet portion and the outlet portion of the diffuser flow path. However, according to the conventional diffuser pipe, when the opening area ratio is increased to a certain value, a blockage of passage starts increasing to such an extent that a desired effective opening area ratio cannot be achieved. This blockage is believed to be due to the velocity gradient that is created in the curved section of the diffuser passage. The velocity of the air (the working fluid) flowing along the outer side of the curved section is greater than that of the air flowing along the inner side of the curved section. The existence of this low velocity region is believed to be responsible for the increase in the blockage.

SUMMARY OF THE INVENTION

In view of such a problem of the prior art, a primary object of the present invention is to reduce the blockage of the diffuser passages of a pipe diffuser, and improve the performance of the pipe diffuser.

To achieve such an object, the present invention provides a pipe diffuser (50) of a centrifugal compressor (42), comprising: a plurality of diffuser pipes (51) arranged circumferentially at a prescribed interval around an impeller (44) of a centrifugal compressor, each diffuser pipe defining a diffuser passage (70) configured to convert a radial flow of working fluid received from the impeller into an axial flow substantially in parallel with a central axial line of the impeller, the diffuser passage including an inlet passage portion (74) including a diffuser inlet (72) opposing an outer periphery of the impeller, an outlet passage portion (78) including a diffuser outlet (76) opening in an axial direction of the impeller, the outlet passage portion having an oval cross section elongated in a substantially circumferential direction of the impeller, and a curved passage portion (80) connecting the inlet passage portion and the outlet passage portion to each other, the diffuser passage having a cross sectional area progressively increasing from the diffuser inlet to the diffuser outlet, wherein a part of each diffuser pipe defining the outlet passage portion is provided with a bulging part (82) that bulges into the diffuser passage from a radially inner side thereof with respect to the impeller.

According to this arrangement, the low velocity region of the working fluid in the diffuser passage is reduced owing to the presence of the bulging part so that the passage blockage is minimized, and the performance of the diffuser pipe can be improved. The cross section of the diffuser pipe may have an oval shape which may include an elliptic shape, a track-shape (two semicircles joined by a rectangle) or any other elongated circular shape.

In this pipe diffuser, preferably, the bulging part (82) is formed centrally along a long axis of the cross section of the outlet passage portion.

The long axis typically coincides with the circumferential direction of the impeller. Thereby, the low velocity region of the working fluid is effectively minimized owing the presence of the bulging part.

In this pipe diffuser, preferably, the bulging part (82) extends from a starting point of the curved passage portion (80) to the diffuser outlet (76), and a cross sectional area of the bulging part is progressively increased toward the diffuser outlet.

Thereby, the low velocity region of the working fluid is effectively minimized owing to the presence of the bulging part.

In this pipe diffuser, preferably, a length of a base of the bulging part as measured along a long axis direction of the oval cross section of the outlet passage portion is ½ to 7/10 of a dimension of the outlet passage portion as measured along the long axis direction of the oval cross section of the outlet passage portion.

Thereby, the low velocity region of the working fluid is particularly effectively minimized owing to the presence of the bulging part.

In this pipe diffuser, preferably, a length of the bulging part as measured along a short axis direction of the oval cross section of the outlet passage portion is ½ to 4/5 of a dimension of the outlet passage portion as measured along the short axis direction of the oval cross section of the outlet passage portion.

Thereby, the low velocity region of the working fluid is even more effectively minimized by the presence of the bulging part.

According to the pipe diffuser of the present invention, the presence of the bulging part allows the blockage of the diffuser passages of the pipe diffuser to be reduced, and the performance of the pipe diffuser to be improved.

DESCRIPTION OF THE PREFERRED EMBODIMENT(S)

A preferred embodiment of the present invention is described in the following with reference to the appended drawings.

Figure 1:
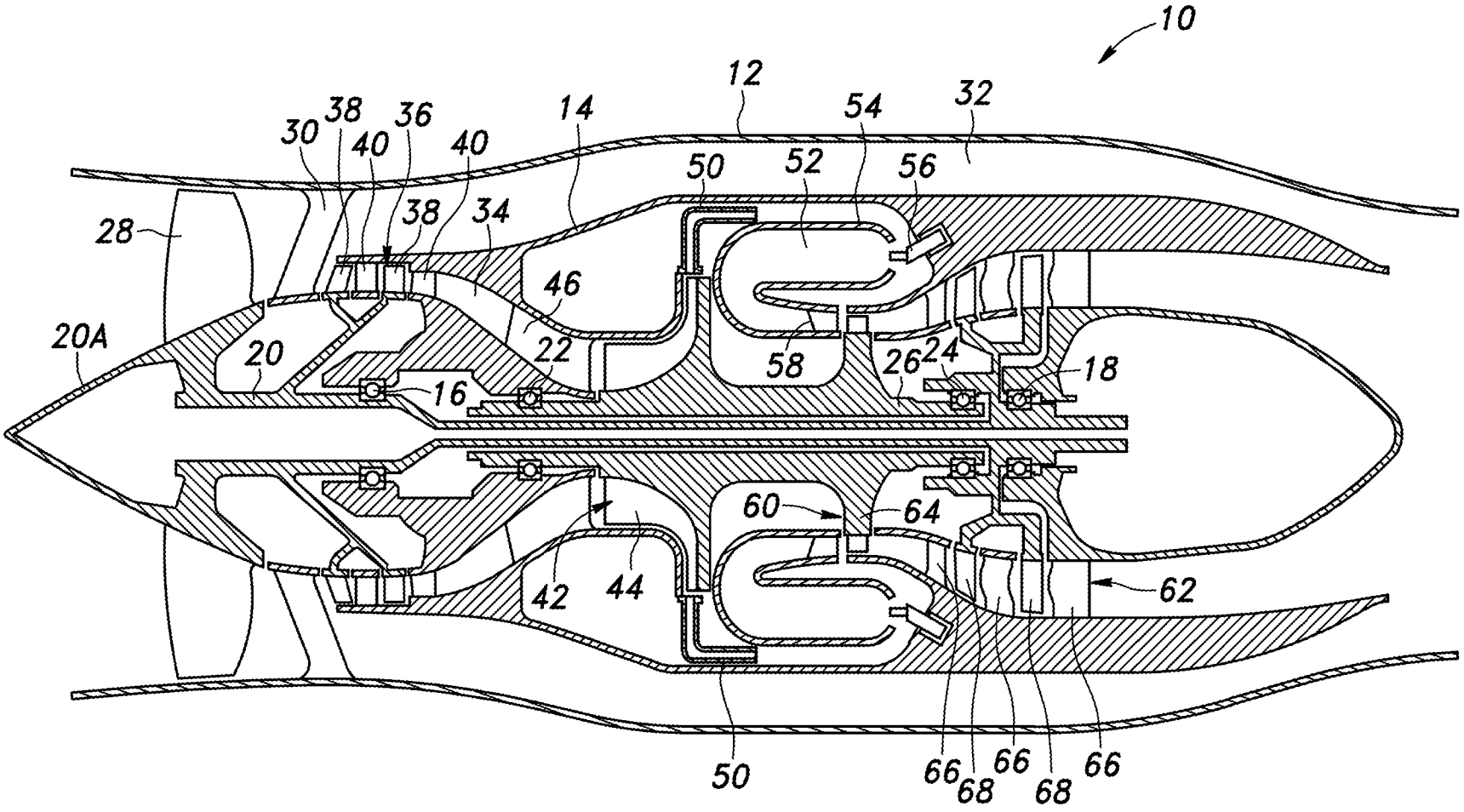
FIG. 1 is a sectional view showing an outline of a gas turbine engine for aircraft incorporated with a pipe diffuser according to an embodiment of the present invention.

FIG. 1 shows an outline of a gas turbine engine (turbofan engine) for aircraft using a centrifugal compressor according to an embodiment of the present invention.

The gas turbine engine 10 is provided with an outer casing 12 and an inner casing 14 which are substantially cylindrical in shape, and are coaxially arranged relative to each other. The inner casing 14 rotatably supports a low pressure rotating shaft 20 via a front first bearing 16 and a rear first bearing 18 fitted on the outer periphery of the low pressure rotating shaft 20. The inner casing 14 also rotatably supports a high pressure rotating shaft 26 consisting of a hollow shaft coaxially receiving the low pressure rotating shaft 20 therein via a front second bearing 22 and a rear second bearing 24 fitted on the outer periphery of the high pressure rotating shaft 26.

The low pressure rotating shaft 20 includes a substantially conical front end portion 20A projecting axially forward from the inner casing 14, and surrounded by a front end part of the outer casing 12. A front fan 28 is provided on the outer periphery of the front end portion 20A. A plurality of stator vanes 30 each having an outer end joined to the outer casing 12 and an inner end joined to the inner casing 14 are provided on the downstream side of the front fan 28 at a regular interval in the circumferential direction. On the downstream side of the stator vane 30, a bypass duct 32 having an annular cross sectional shape is defined between the outer casing 12 and the inner casing 14, and an air compression duct (annular fluid passage) 34 having an annular cross sectional shape is defined inside the inner casing 14 in a coaxial relationship (concentric with the central axial line).

An axial compressor 36 is provided in an inlet part of the air compression duct 34. The axial compressor 36 is provided with two rows of rotor blades 38 extending radially outward from the front end portion 20A of the low pressure rotating shaft 20, and two rows of stator vanes 40 extending radially inward from the inner casing 14 in such a manner that the rows of the stator vanes 40 and the rows of the rotor blades 38 are arranged axially in close proximity and in an alternating manner.

An outlet part of the air compression duct 34 is provided with a plurality of stator vanes 46, and a centrifugal compressor 42 is provided immediately downstream of the stator vanes 46.

The outlet side of the centrifugal compressor 42 is provided with a pipe diffuser 50 that includes a plurality of diffuser pipes 51 arranged circumferentially around the impeller 44.

A plurality of reverse-flow combustors 52 are formed on the downstream side of the pipe diffuser 50 to receive compressed air from the pipe diffuser 50. The inner casing 14 is provided with a plurality of fuel injectors 56 for injecting fuel into the reverse-flow combustors 52. The reverse-flow combustors 52 generate high pressure combustion gas by the combustion of the mixture of the fuel and the air. A row of nozzle guide vanes 58 are provided downstream of the reverse-flow combustors 52.

Downstream to the nozzle guide vanes 58 are provided a high pressure turbine 60 and a low pressure turbine 62 in that order. The combustion gas generated by the reverse-flow combustors 52 is forwarded to the high pressure turbine 60 and the low pressure turbine 62. The high pressure turbine 60 includes a high pressure turbine wheel 64 fixed to the outer periphery of the high pressure rotating shaft 26 immediately downstream of the nozzle guide vanes 58. The low pressure turbine 62 includes a plurality of rows of nozzle guide vanes 66 fixedly attached to the inner casing 14 and a plurality of low pressure turbine wheels 68 fixedly attached to the outer periphery of the low pressure rotating shaft 20 so as to alternate with the rows of the nozzle guide vanes 66.

The gas turbine engine 10 is provided with a starter motor (not shown in the drawings) for starting the engine by rotatively driving the high pressure rotating shaft 26. When the high pressure rotating shaft 26 is rotatively driven, the intake air is compressed by the centrifugal compressor 42, and is forwarded to the reverse-flow combustors 52. The fuel injected from the fuel injectors 56 is mixed with the compressed intake air, and combusted in the reverse-flow combustors 52. The produced combustion gas is forwarded to the high pressure turbine wheel 64 and the low pressure turbine wheels 68 to rotatively drive the high pressure and low pressure turbine wheels 64 and 68.

As a result, the low pressure rotating shaft 20 and the high pressure rotating shaft 26 are rotatively driven so as to cause the front fan 19 to be rotated, and the axial compressor 36 and the centrifugal compressor 42 to be operated so that the compressed air is supplied to the reverse-flow combustors 52. Once this cycle is established, the gas turbine engine 10 continues operation even after the starter motor is stopped.

During the operation of the gas turbine engine 10, a part of the air drawn by the front fan 28 passes through the bypass duct 32 and is ejected rearward to create a thrust primarily during low speed flight. The remaining part of the air drawn by the front fan 28 is supplied to the reverse-flow combustors 52, and mixed with the fuel to combust the fuel. The resulting combustion gas rotatively drives the low pressure rotating shaft 20 and the high pressure rotating shaft 26, and is ejected rearward to create a thrust.

Figure 2:
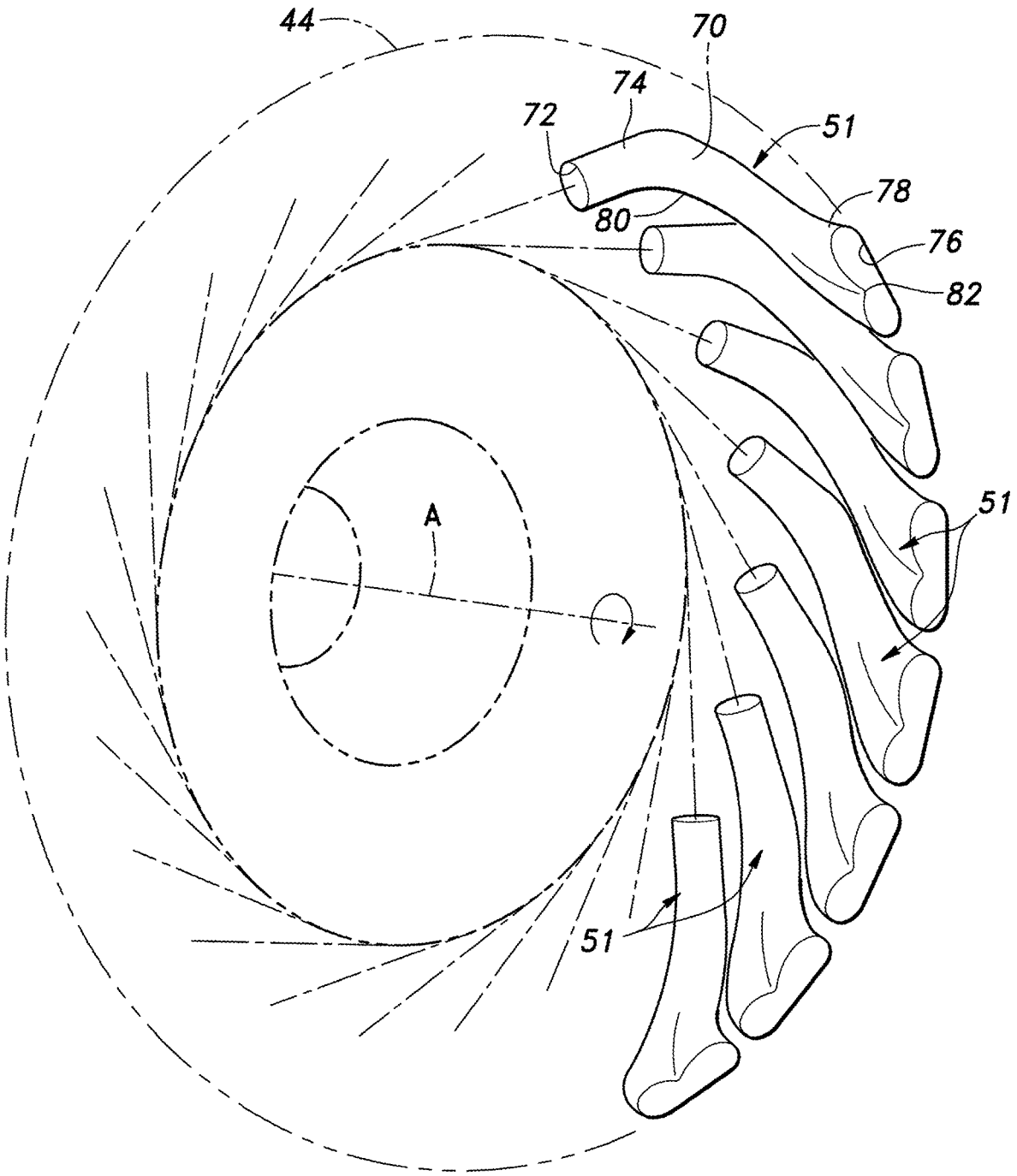
FIG. 2 is an overall perspective view of the pipe diffuser.

The details of the diffuser pipe 51 will be described in the following with reference to FIGS. 2 to 4.

The diffuser pipe 51 internally defines a diffuser passage 70 that is configured to convert the radial flow of the working fluid received from the impeller 44 into an axial flow substantially in parallel with the center axis (axial direction) of the impeller 44. The diffuser passage 70 includes an inlet passage portion 74 extending substantially radially (at a certain tangential angle to the radial line) from the outer periphery of the impeller 44 and having a diffuser inlet 72 at an upstream end thereof, an outlet passage portion 78 extending in the axial direction of the impeller 44 and including a diffuser outlet 76 at a downstream end thereof, and a curved passage portion 80 connecting the inlet passage portion 74 and the outlet passage portion 78 to each other. The diffuser passage 70 is provided with a cross sectional shape having an oval shape which may include an elliptic shape, a track-shape (two semicircles joined by a rectangle) or any other elongated circular shape, substantially over the entire length thereof. The cross sectional area of the diffuser passage 70 progressively increases from the diffuser inlet 72 to the diffuser outlet 76.

In the illustrated embodiment, the cross sectional shape of the diffuser passage 70 has a long axis and a short axis which are substantially orthogonal to each other (but may also be at an angle other than 90 degrees), and the long axis is oriented in the circumferential direction over the entire length of the diffuser passage 70. The cross sectional shape of the diffuser passage 70 may change along the length thereof. In a certain embodiment, the cross sectional shape of the diffuser passage 70 is circular at least in a part of the inlet passage portion thereof.

Each diffuser pipe 51 is provided with a bulging part 82 that bulges into the diffuser passage 70 from the radially inner side thereof with respect to the impeller 44, and this bulging part 82 extends from a start point of the curved passage portion 80 to the diffuser outlet 76. The bulging part 82 has a triangular cross section having a base substantially coinciding with a hypothetical profile of the oval cross section thereof, and the cross section progressively increases in size from the curved passage portion 80 toward the diffuser outlet 76. In other words, the cross sectional area of the bulging part 82 progressively increases from an upstream end to a downstream end thereof. The bulging part 82 is positioned substantially at the midpoint of the radially inner side of the oval cross section with respect to the center of the impeller 44. In other words, the bulging part 82 is formed centrally along a long axis of the cross section of the diffuser outlet passage portion 78 on the inner side of the oval cross section.

The diffuser pipe 51 is configured such that the cross sectional area of the diffuser passage 70 increases smoothly over the entire length thereof in spite of the presence of the bulging part 82. To this end, the cross sectional area of the hypothetical profile of the oval cross section thereof is increased so as to compensate for the presence of the bulging part 82. Therefore, there is no reduction in the cross sectional area of the diffuser passage 70 owing to the provision of the bulging part 82. As a result, a required opening area ratio of the diffuser pipe 51 is secured.

In the illustrated embodiment, since the diffuser pipe 51 is made of sheet metal, the bulging part 82 creates a corresponding recess in a part of the outer side of the diffuser pipe 51 corresponding to the bulging part 82.

Figure 3:
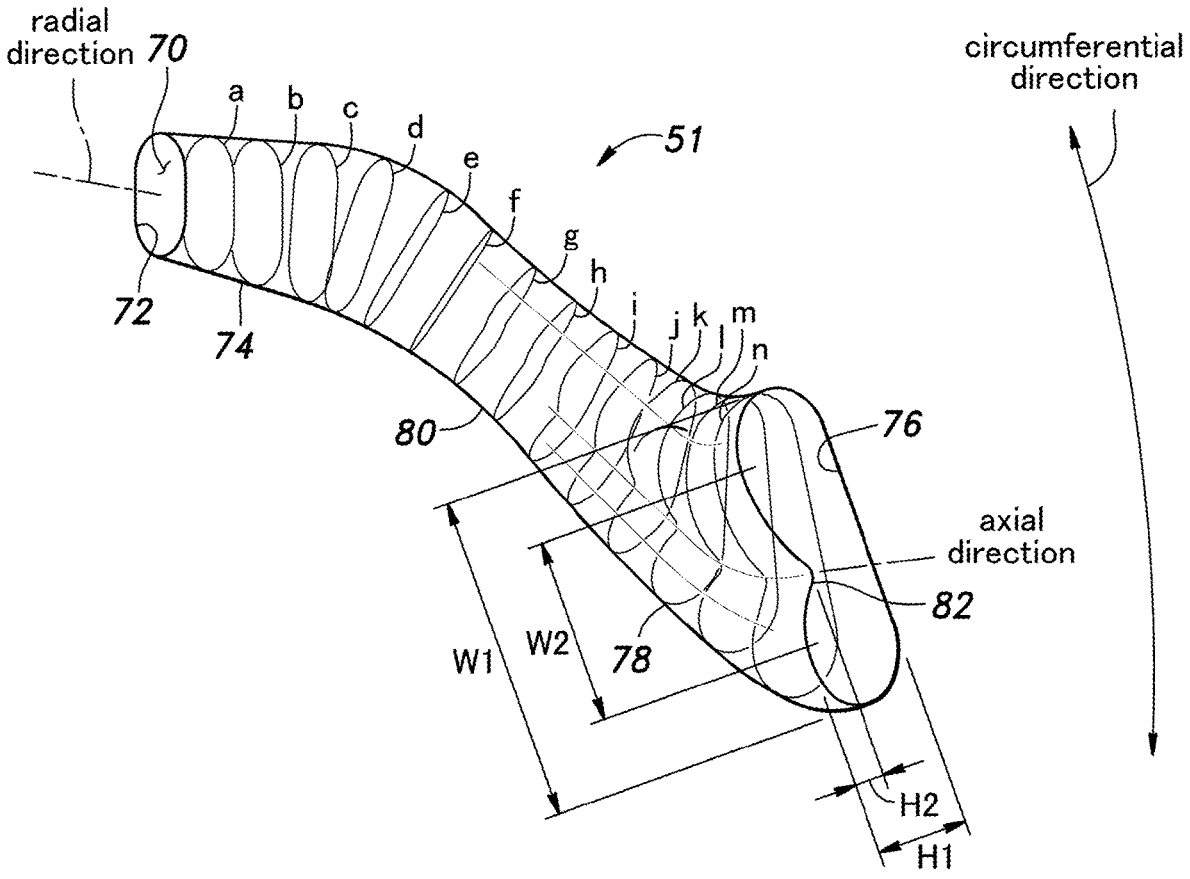
FIG. 3 is a perspective view of a diffuser pipe of the pipe diffuser.

FIG. 3 shows the cross sectional shape of the diffuser passage 70 at each of a plurality of points defined along the length of the diffuser passage 70 which are indicated by different letters a to n. As can be seen from FIG. 3, the bulging part 82 is located in a radially inner side of the diffuser passage 70 with respect to the impeller 44, and extends from a starting point of the curved passage portion 80 to the diffuser outlet 76. The bulging volume or the cross sectional area of the bulging part 82 progressively increases from the curved passage portion 80 to the diffuser outlet 76 so as to correspond to the progressive increase in the cross sectional area of the diffuser passage 70 to the diffuser outlet 76.

Figure 4:
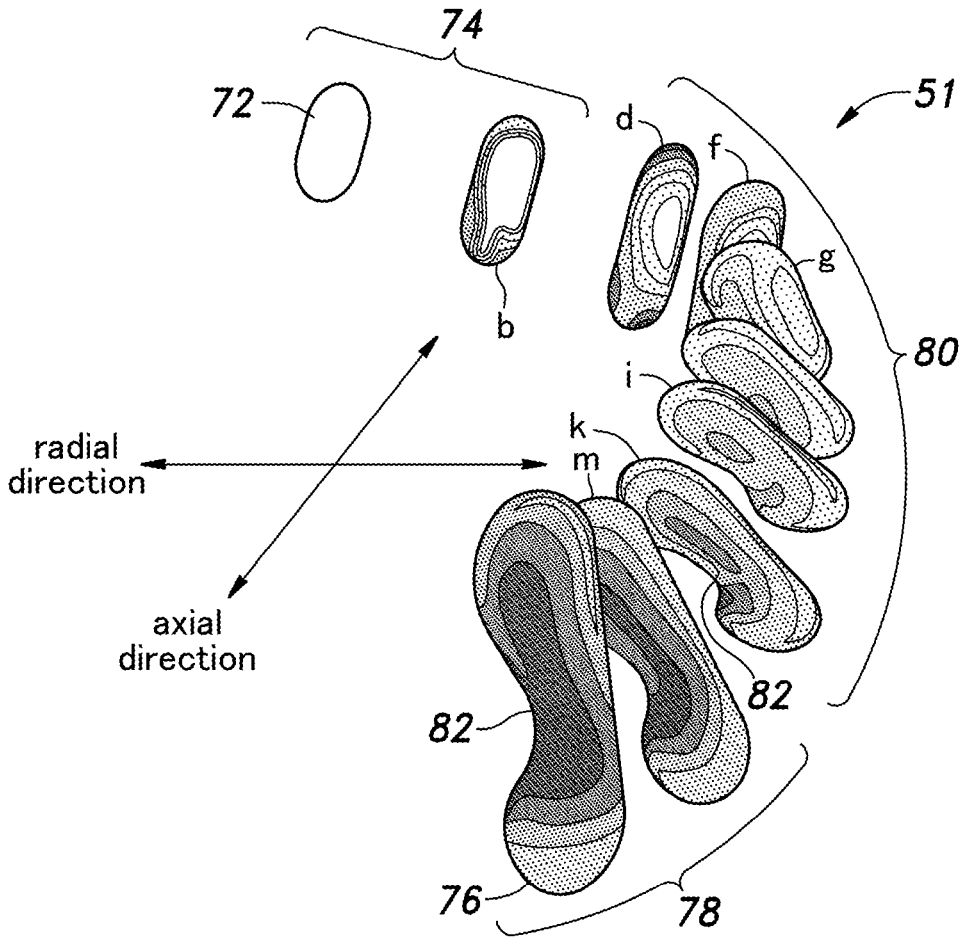
FIG. 4 is a diagram showing a flow velocity distribution of working fluid in the diffuser pipe.

FIG. 4 shows the flow velocity distribution of the working fluid in the cross section of each of the points defined along the length of the diffuser passage 70. In FIG. 4, the light portion indicates the maximum flow velocity region, and the darker portions indicate lower flow velocity regions. The darker the area is, the greater the flow velocity in the particular region is. The darkest part indicates the minimum flow velocity region. The minimum flow velocity region is formed on the inner side of the diffuser passage 70 with respect to the radial direction of the impeller 44, and significantly contributes to the increase in the passage blockage ratio. As can be seen from FIG. 4, the minimum flow velocity region is created generally in a midpoint region of the radially inner side of the oval cross section with respect to the center of the impeller 44, or centrally along the long axis of the cross section of the diffuser outlet passage portion 78 on the inner side of the oval cross section. Thus, the bulging part 82 is provided in a part corresponding to the minimum flow velocity region in order to reduce the minimum flow velocity region.

Figure 5A:
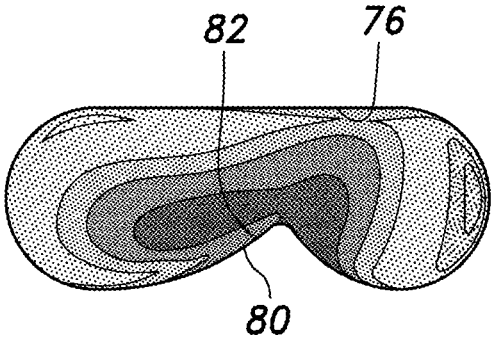
FIG. 5A is a diagram showing a flow velocity distribution of working fluid at an outlet portion of the diffuser pipe of the present embodiment.
Figure 5B:
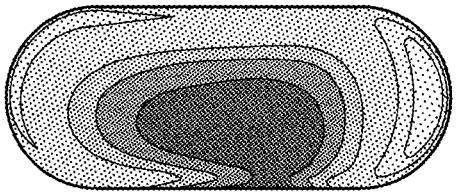
FIG. 5B is a diagram showing a flow velocity distribution of working fluid at an outlet portion of a conventional diffuser pipe.

FIG. 5A shows the flow velocity distribution of the working fluid at the diffuser outlet 76 of the diffuser pipe 51 according to the present embodiment provided with the bulging part 82. FIG. 5B shows the flow velocity distribution of the working fluid at the diffuser outlet of the conventional diffuser pipe.

Since the bulging part 82 is provided in the minimum flow velocity region, the minimum flow velocity region decreases in size so that the passage blockage ratio of the diffuser pipe 51 decreases as compared with the case where the bulging part 82 is not provided. Thereby, the performance of the diffuser pipe 51 is improved, and the performance of the gas turbine engine 10 is improved.

Since the bulging part 82 is formed in the central part along the long axis direction of the oval cross section of the diffuser outlet passage portion 78 corresponding to the minimum flow velocity region, the minimum flow velocity region of the working fluid is effectively reduced by the presence of the bulging part 82, and the increase in the overall size of the pipe diffuser 50 can be avoided.

The size of the bulging part 82 may be determined according to the flow velocity distribution of the working fluid. In order to effectively reduce the passage blockage ratio, as shown in FIG. 3, a length W2 of the base of the bulging part 82 as measured along a long axis direction of the oval cross section of the diffuser outlet passage portion 78 is ½ to 7/10 of a dimension W1 of the diffuser outlet passage portion 78 as measured along the long axis direction of the oval cross section of the diffuser outlet passage portion 78. Also, a length (protruding height) H2 of the bulging part 82 as measured along a short axis direction of the oval cross section of the diffuser outlet passage portion 78 is ½ to 4/5, more preferably ½ to 2/5 of a dimension H1 of the diffuser outlet passage portion 78 as measured along the short axis direction of the oval cross section of the diffuser outlet passage portion 78.

As a result, the low flow velocity region of the working fluid is effectively reduced by the bulging part 82, and the increase in the size of the diffuser pipe 51 due to the provision of the bulging part 82 is minimized.

Figure 6:
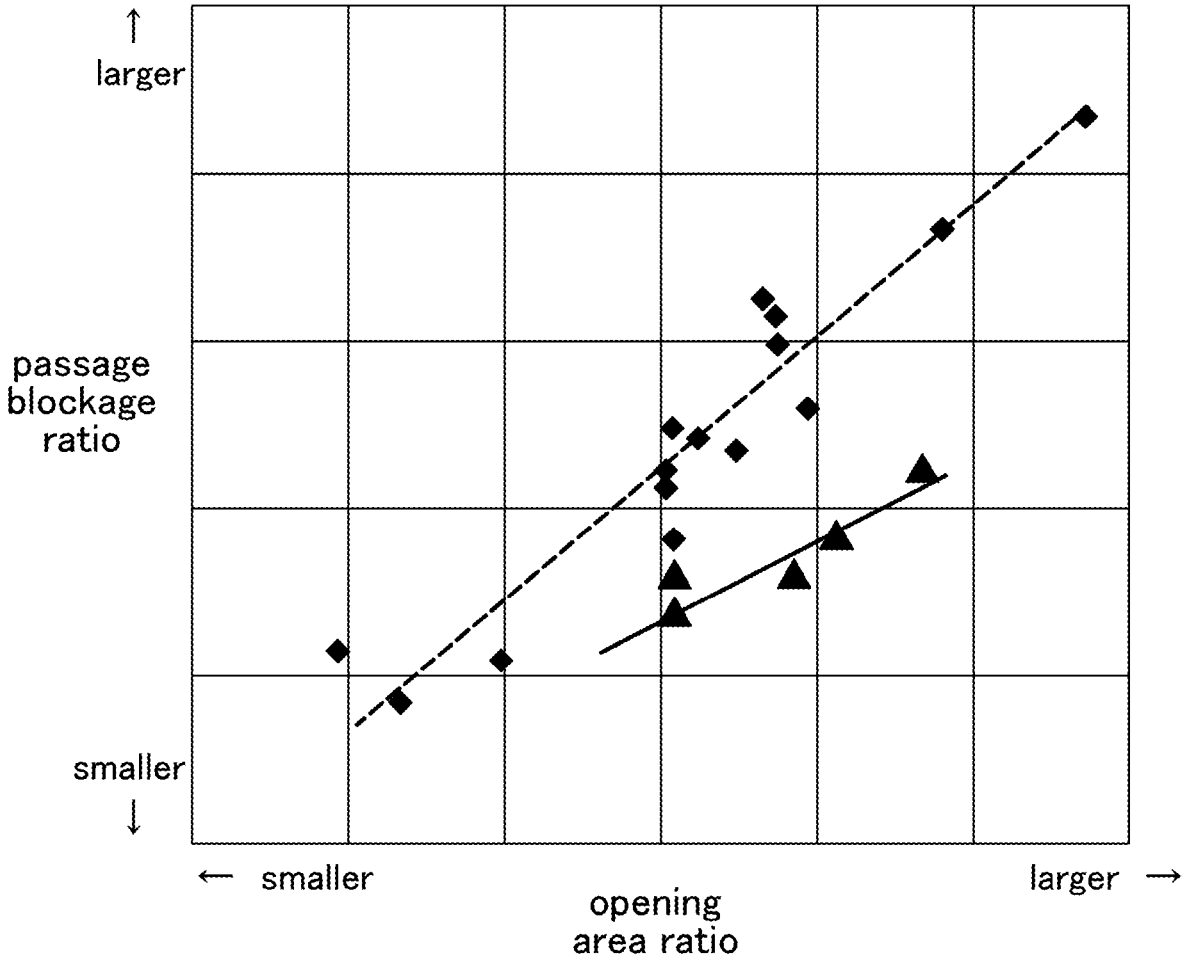
FIG. 6 is a graph showing the relationship between an opening area ratio and a passage blockage ratio of the diffuser pipe.

In FIG. 6, the solid line shows the characteristic of the passage blockage ratio with respect to the opening area ratio of the diffuser pipe 51 according to the present embodiment provided with the bulging part 82 while the broken line shows the opening area ratio of the conventional diffuser pipe not provided with a bulging part.

As can be seen from FIG. 6, in the case of the diffuser pipe 51 of the present embodiment, the passage blockage ratio also increases in accordance with an increase in the opening area ratio in a similar manner as in the case of the conventional diffuser pipe, but the value level of the passage blockage ratio and the increase rate of the passage blockage ratio in relation to the opening area ratio are significantly lower than those of the conventional diffuser pipe.

Although the present invention has been described in terms of a preferred embodiment thereof, the present invention is not limited by such an embodiment, but can be appropriately modified without departing from the spirit of the present invention. For example, the cross sectional shape of the bulging part 82 is not limited to a triangular shape, but may also be an arcuate bulging shape or an irregular shape corresponding to the flow velocity distribution of the working fluid in the diffuser outlet passage portion 78. The bulging part 82 is not necessarily provided from the starting point of the curved passage portion 80 to the diffuser outlet 76, but may be provided in any other part of the diffuser passage 70 where the low flow velocity region is created. Generally, it is advantageous to provide the bulging part 82 at least on the inner side of the diffuser outlet 76 and the vicinity thereof with respect to the radial direction of the impeller 44.

The invention claimed is:

1. A pipe diffuser of a centrifugal compressor, comprising:

a plurality of diffuser pipes arranged circumferentially at a prescribed interval around an impeller of a centrifugal compressor, each diffuser pipe defining a diffuser passage configured to convert a radial flow of working fluid received from the impeller into an axial flow substantially in parallel with a central axial line of the impeller, the diffuser passage including an inlet passage portion including a diffuser inlet opposing an outer periphery of the impeller, an outlet passage portion including a diffuser outlet opening in an axial direction of the impeller, the outlet passage portion having an oval cross section elongated in a substantially circumferential direction of the impeller, and a curved passage portion connecting the inlet passage portion and the outlet passage portion to each other, the diffuser passage having a cross sectional area progressively increasing from the diffuser inlet to the diffuser outlet, wherein a part of each diffuser pipe defining the outlet passage portion is provided with a bulging part that bulges into the diffuser passage from a radially inner side thereof with respect to the impeller.

2. The pipe diffuser according to claim 1, wherein the bulging part is formed centrally along a long axis of the cross section of the outlet passage portion.

3. The pipe diffuser according to claim 1, wherein the bulging part extends from a starting point of the curved passage portion to the diffuser outlet, and a cross sectional area of the bulging part is progressively increased toward the diffuser outlet.

4. The pipe diffuser according to claim 1, wherein a length of a base of the bulging part as measured along a long axis direction of the oval cross section of the outlet passage portion is ½ to 7/10 of a dimension of the outlet passage portion as measured along the long axis direction of the oval cross section of the outlet passage portion.

5. The pipe diffuser according to claim 1, wherein a length of the bulging part as measured along a short axis direction of the oval cross section of the outlet passage portion is ½ to 4/5 of a dimension of the outlet passage portion as measured along the short axis direction of the oval cross section of the outlet passage portion.

* * * * *